United States Patent [19]

Mogtader

[11] 3,977,319

[45] Aug. 31, 1976

[54] DRUM COLUMN PRINTER

[75] Inventor: Charles S. Mogtader, Beverly Hills, Calif.

[73] Assignee: Dataproducts Corporation, Woodland Hills, Calif.

[22] Filed: Nov. 24, 1975

[21] Appl. No.: 634,838

Related U.S. Application Data

[63] Continuation of Ser. No. 457,464, April 3, 1974, abandoned.

[52] U.S. Cl. ..... 101/93.08; 101/93.18

[51] Int. Cl.[2] ..... B41J 9/12

[58] Field of Search ..... 101/93.08, 93.18, 93.2, 101/93.29–93.34, 93.48, 95, 99, 110, 66, 67; 197/18, 55

[56] References Cited

UNITED STATES PATENTS

| | | | |
|---|---|---|---|
| 3,077,158 | 2/1963 | Hoffmann | 101/93.08 |
| 3,136,243 | 6/1964 | Christoff | 101/93.08 |
| 3,168,182 | 2/1965 | Bernard et al. | 101/55 |
| 3,517,165 | 6/1970 | Peyton | 235/61.9 |
| 3,605,978 | 9/1971 | Kawano | 101/93.18 X |
| 3,633,497 | 1/1972 | Hartley | 101/93.18 X |
| 3,675,753 | 7/1972 | Perucca | 101/18 |
| 3,890,893 | 6/1975 | Kodis | 101/23.28 X |

*Primary Examiner*—Edgar S. Burr
*Assistant Examiner*—Edward M. Coven
*Attorney, Agent, or Firm*—Lindenberg, Freilich, Wasserman, Rosen & Fernandez

[57] ABSTRACT

An impact printer including a type bearing drum mounted for rotation about the axis of the drum and including a plurality of hammers mounted with the impact faces thereof opposed to the drum and aligned in a direction extending parallel to the drum axis. Raised characters formed on the drum surface are oriented so that a line extending from top to bottom of the character is parallel to the drum axis. As a consequence, as the drum rotates through one revolution, the hammers can be selectively impacted against the drum to print a complete column of text on a paper web therebetween. Since the characters move past the hammers along a horizontal line of text, excellent vertical registration of the characters in a line is assured.

2 Claims, 3 Drawing Figures

DRUM COLUMN PRINTER

This is a continuation of application Ser. No. 457,464, filed Apr. 3, 1974, now abandoned.

BACKGROUND OF THE INVENTION

This invention relates to improvements in impact printers of the type generally employed in data processing systems and more particularly to a drum printer particularly configured to achieve superior vertical registration of printed characters.

Impact printers employing rotating character drums are well known in the prior art. They generally include a plurality of hammers mounted with their impact faces aligned in a row extending parallel to the drum axis. As the drum rotates, different rows of characters on the drum are successively moved into the print station; i.e. into a position opposed to the row of impact faces. Actuation of a hammer propels it against the opposed character on the drum to thus print the character on a paper web therebetween.

The characters on the drum are conventionally arranged in rows extending parallel to the drum axis and rings extending around the drum axis. Typically, the printer will include a number of hammers equal to the number of rings on the drum so as to enable a full line of text to be printed during a single drum revolution. After each line is printed, the paper web is moved by a unit length corresponding to the line spacing, and a subsequent line is printed.

Since the characters on the drum move past the hammer impact faces perpendicular to the lines of text, slight timing variations between the impacting of the hammers results in vertical misalignment of characters in the printed line. Such misalignments, of course, become more pronounced as printing speeds increase.

A different type of impact printer which avoids the aforementioned vertical misalignment problem utilizes a type bearing surface, such as a chain or band, in lieu of the drum, which moves characters past the hammer impact faces along a line of text. In this type of printer, impact timing variations result in horizontal print variations which are not nearly as noticeable to the eye as are vertical misalignments. The disadvantages of known printers using such horizontally moving characters has been primarily that they are more costly and require more maintenance than known drum type machines.

SUMMARY OF THE INVENTION

The present invention is directed to an improved impact printer utilizing a character drum mounted so as to move characters past a row of hammers along a line of text to be printed. As a consequence, the vertical registration advantage of a chain-type printer is achieved while retaining the cost and maintenance advantages of a drum printer.

More particularly, in accordance with the invention, a page is printed one column at a time rather than one line at a time as has been typical of prior art drum printers. A "column" of print shall be understood as meaning a direction extending between the top and bottom margins of a page of text. A "line" of print shall be understood as meaning a direction extending between the left and right margins of a page of text. For the sake of clarity herein in explaining the orientation of various parts of the printer structure, the term "vertical" will be used to indicate a direction parallel to the printed column and the term "horizontal" to indicate a direction parallel to the printed line. The terms vertical and horizontal should not be understood as suggesting any particular orientation with respect to the earth.

DESCRIPTION OF THE DRAWINGS

FIG. 1(*b*) schematically illustrates the manner in which a paper web is moved past the print station in accordance with the drum printer of the present invention;

DESCRIPTION OF THE PREFERRED EMBODIMENT

Figure 1A:
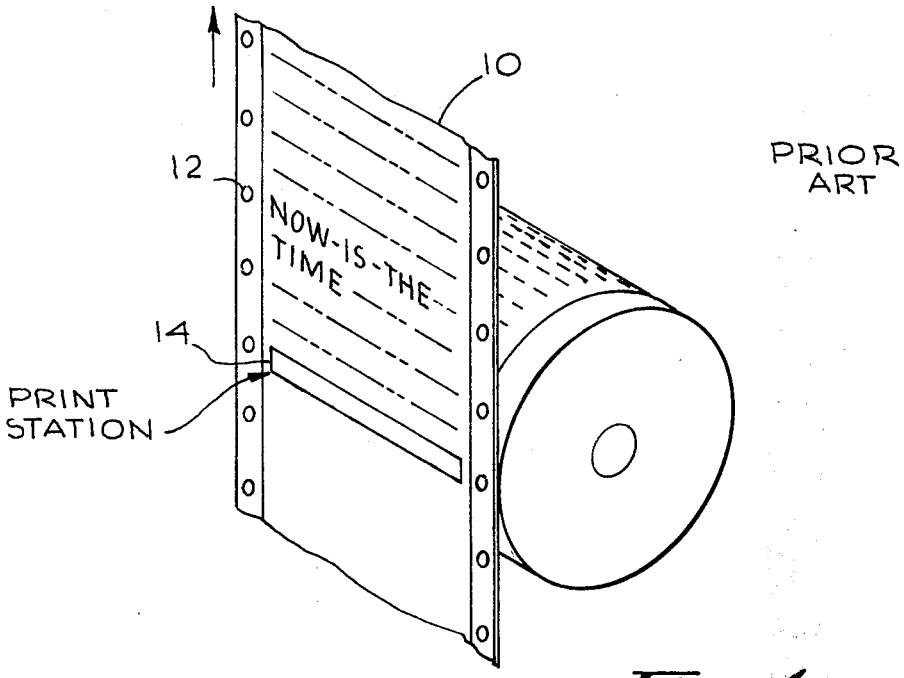
FIG. 1(*a*) schematically illustrates the manner in which a paper web is moved past a print station in a conventional drum printer.
Figure 1B:
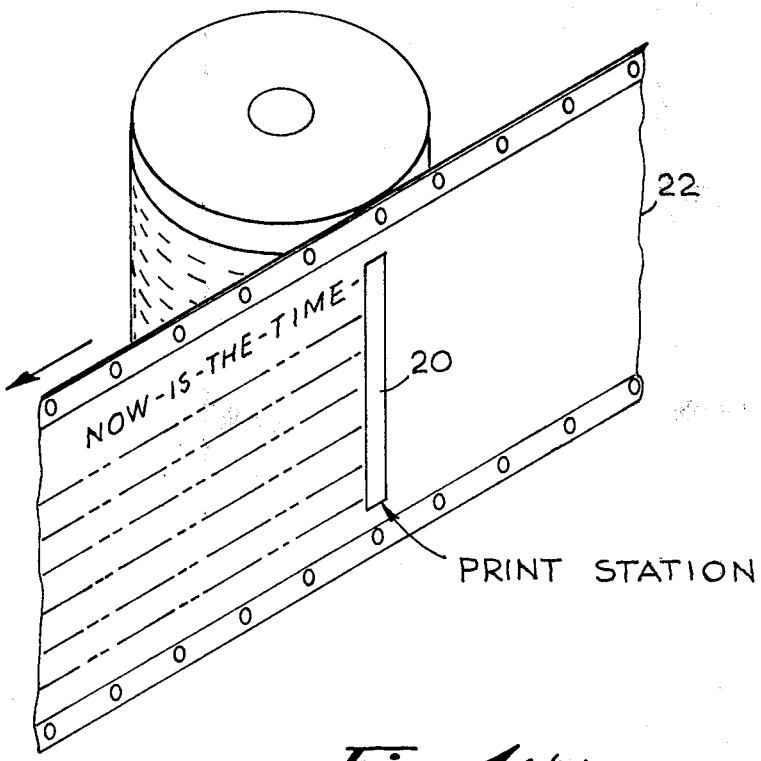

Attention is now called to FIG. 1(*a*) which schematically illustrates the manner in which a conventional drum printer prints text material on a paper web 10. Briefly, the paper web 10 is normally provided with perforations 12 along the edge thereof which are engaged by tractors (not shown) for stepping the paper past a print station 14, usually including a bank of individually actuatable hammers. The hammers are normally disposed adjacent the rear side of the paper and the paper is drawn between the hammers and a type bearing surface such as a rotating drum. Typically the drum has raised characters formed on the surface thereof arranged in rows extending parallel to the drum axis and rings extending around the drum axis. As the drum rotates, the characters thereon move past the print station, moving perpendicular to the lines of text to be printed. The hammers are actuated at appropriate times to impact against the rear surface of the paper to force the paper against a printing ribbon and the selected character on the drum. As a consequence, the selected character is printed on the front surface of the paper. In this manner, one line of text can be printed on the paper web 10 during each revolution of the drum. After a line has been printed, the paper web 10 is stepped by a distance equal to the spacing between lines and a subsequent line is printed.

Since the characters on the drum move past the print station perpendicular to the lines being printed, as represented in FIG. 1, vertical registration errors will occur due to timing variations in the impacting of the hammers.

Printers of various sizes are known in the prior art and are readily commercially available. A typical page format, which for convenience will be assumed herein, consists of 66 lines and 132 columns of text. In a typical prior art printer, such a format would require that the printer consist of 132 hammers to print a full line in one drum revolution. The paper would have to be moved through 66 steps to print the 66 lines.

Attention is now called to FIG. 1(*b*) which schematically illustrates the manner in which printing is accomplished in accordance with the present invention. Instead of the print station extending parallel to a line of text, as in FIG. 1(*a*), in accordance with the present invention, the print station 20 is oriented so as to print a full page column at one time. In order to do this, of course, the print station 20 would consist of 66 hammers (or some sub-multiple thereof) with each hammer functioning to print a character in a different page line.

The paper web 22 is moved past the print station 20 through 132 steps to print a page. As will be described in greater detail hereinafter, in accordance with the present invention as represented in FIG. 1(*b*), a character drum is provided in which the characters move past the print station along a line to be printed. Each line of text is printed by a different hammer and most importantly, each hammer prints all of the characters in a line. Consequently, timing variations due, for example, to aging, in the impacting of a hammer will not produce either vertical or horizontal misalignment of characters in a line.

Figure 2:
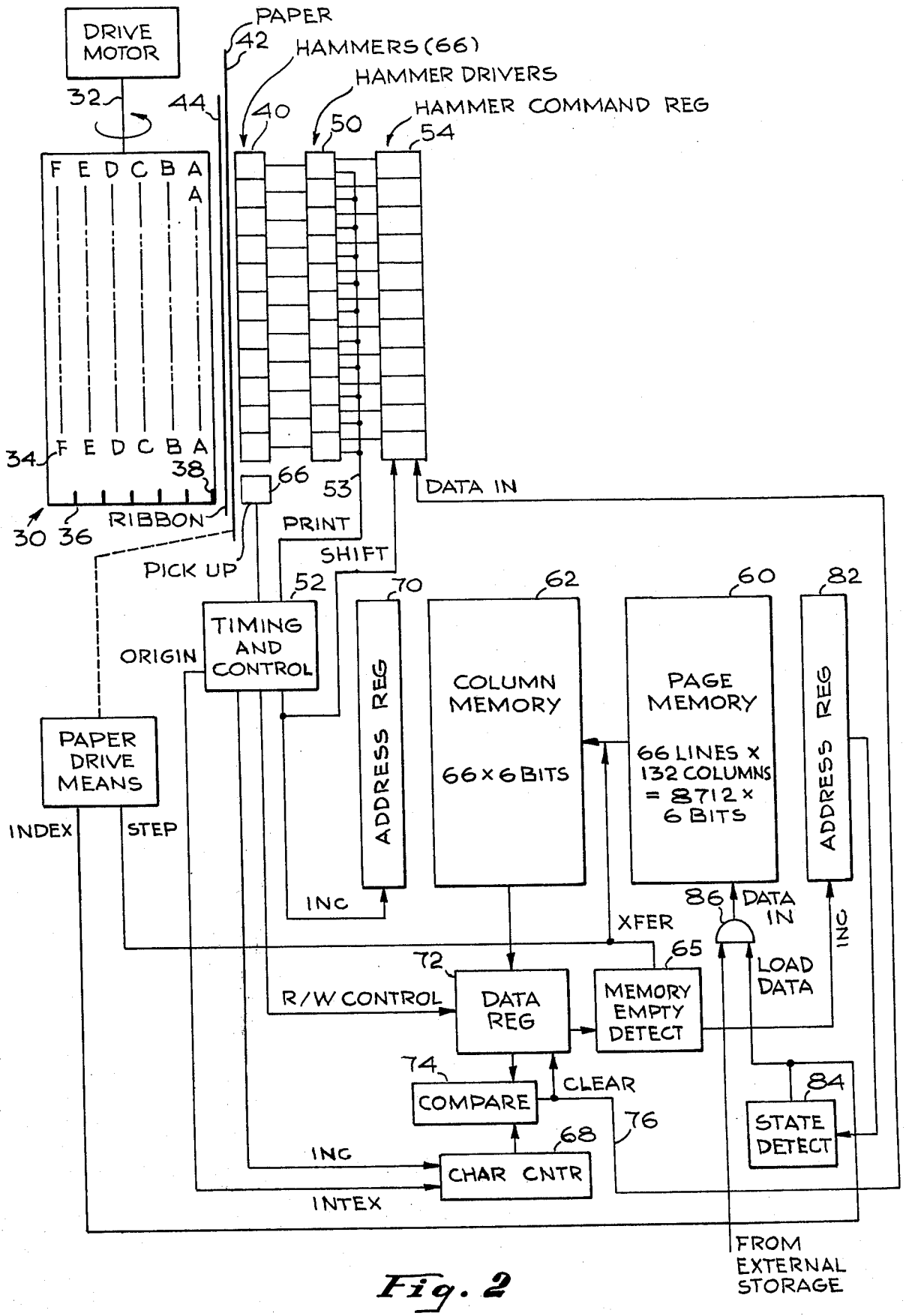
FIG. 2 is a schematic block diagram illustrating a printer apparatus in accordance with the present invention.

Attention is now called to FIG. 2 which illustrates a printer apparatus constructed in accordance with the prsent invention. The printer of FIG. 2 includes a character drum 30 mounted for rotation about its vertically oriented axis 32. As was previously mentioned, reference to vertical orientation is intended to mean parallel to a column to be printed, rather than a particular orientation with respect to the earth.

Raised characters 34 are formed on the circumferential surface of the drum arranged in rows extending parallel to the drum axis 32 and rings extending around the drum axis. It is important to note that in accordance with the present invention, the characters 34 are oriented so that a line extending from the top to bottom of a character extends parallel to the drum axis 32. The character drum 32 is provided with timing marks 36 each of which identifies a new character row. A unique timing mark 38 is provided in association with one row on the drum for the purpose of generating an origin or index pulse, to be used in a manner to be described hereinafter.

A hammer bank 40 comprised of 66 different individually actuatable hammers is mounted adjacent to the drum extending along a line parallel to the drum axis. Each of the hammers is aligned with a different ring on the drum surface. Each ring consists of a full character set. Therefore, as the drum 30 rotates, a full set of characters will move past each of the hammers, and by actuating a hammer at an appropriate time, it can be caused to impact against any selected character.

The bank of aligned hammers 40 defines a print row or print station. The paper web 42 to be printed upon is pulled through the print station between the drum 30 and hammer bank 40. A printing ribbon 44 is also pulled past the print station between the paper web 42 and the drum 30.

A plurality of hammer drivers 50 is provided, each hammer driver being connected to a different one of the hammers. Each hammer is activated, that is propelled toward the drum, in response to an appropriate energiizing signal being supplied thereto by its connected hammer driver. The hammer drivers 50 are all enabled during a print interval defined by a print command signal developed by the timing and control logic 52 and supplied on conductor 53. The particular hammer drivers that are enabled depends upon whether or not the corresponding stage of the hammer command register 54 is set.

The manner in which the hammer command register 54 is loaded will be discussed in detail hereinafter. In order to generally understand the operation of the printer of FIG. 2, let it be assumed that certain stages of the hammer command register have been set and that a first character row on the drum is entering the print station. When the timing and control logic 52 generates the print signal, the hammers corresponding to the set hammer command register stages will be activated to impact against the drum and print the impacted characters on the front of the paper web 42. Prior to the second row of characters entering the print station, the hammer command register is again loaded and as the second row of characters passes through the print station, the appropriate hammers 40 are activated to impact against the drum to again print characters on the front side of the paper web. Since the paper web is held stationary during the drum revolution, all of the characters will be printed in a particular column. Since a full character set passes each hammer during a single drum revolution, a full column is printed during that one revolution.

In order to control the manner in which the hammer command register 54 is loaded to cause the desired text to be printed, a digital memory 60 is provided for storing a full page of information. That is, the memory 60 is capable of storing the 8,712 characters in a page comprised of 66 lines, 132 characters per line. It will be assumed that each character is represented by a six-bit code which allows for a character set of up to 64 characters. In addition to the page memory 60, a column memory 62 is provided capable of storing 66 six-bit codes or in other words, all of the characters within a single column. The 132 columns of characters are transferred, in sequence, one column at a time, from the page memory 60 to the column memory 62 is response to a transfer enabling signal supplied on line 64. The transfer enabling signal is supplied by detector circuit 65 when the column memory 62 is empty, as will be discussed hereinafter.

Assume now that the 66 six-bit codes representing the next column of text to be printed have been loaded into the column memory 62. A pickup device 66 is provided to recognize the index mark 38 and the other timing marks 36. The output of the pickup device is suplied to the timing and control logic 52. In response to the index mark 38 passing the pickup device 66, the timing and control logic supplies a index pulse to the input of character counter 68 to force the character counter to define a code identifying the next character entering the print station, e.g. A. Thereafter, the timing and control logic 52 will define 66 successive read/-write cycles to successively access the 66 six-bit codes from the column memory. That is, the timing and control logic will successively increment the address register 70 through 66 counts, each defining a different address location in column memory 62. A read/write opertion is performed with respect to each address location to cause the six-bit code stored in the location to be read out into the data register 72. A compare means 74 compares the six-bit code accessed from the column memory 62 with the next character code stored in the character counter 68. In the event the codes match, then the compare means provides a match signal on output line 76 which is connected to the data input terminal of the hammer command register 54. In addition, the match signal supplied by the compare means 74 on line 76 clears the data register so that an all 0's code is written back into the address location from which the six-bit code had been accessed. In the absence of a match, each six-bit code accessed from the column memory is put back into the location from which it was accessed.

Thus, each of the 66 character codes in the column memory 62 is compared with the next character code stored in the character counter 68. Each match causes a 1 bit to be entered into the first stage of the hammer command register which preferably comprises a shift register. The contents of the hammer command register are shifted in synchronism with the incrementing of the address register 70 through the 66 unique address locations. After the 66 character codes from the column memory 62 have been compared with the code in the character counter 68, the contents of the hammer command register will identify those hammers which should be activated as the immediately succeeding row of characters on the drum enters the print station. provision of the print command signal on line 53 causes the information in the hammer command register 54 to activate the appropriate hammers in the bank 40 to then print characters within one column on the paper.

As the next timing mark 36 is sensed by the pickup device 66 and provided to the timing and control logic 52, the character counter 68 is incremented to thereafter define the character next entering the print station, e.g. B. After the character counter 68 has been incremented, then again the 66 codes are accessed from the column memory and sequentially compared with the code for the next character stored in the counter 68. The previously described action then prints the B characters in the appropriate lines of the column of print under construction.

It has been mentioned that after each code is read from the column memory 62, if it does not match the next character code in the counter 68, it is written back into the location of the column memory from which it was accessed. On the other hand, if it does match, then an all 0's code is written back into the column memory location. It will therefore be appreciated that at some point prior to the end of a full drum revolution, the column memory 62 will be comprised solely of all zero codes meaning that the column of print being constructed has been completed and that a new column of character codes can be transferred from the page memory 60 into the column memory 62. In order to sense when the column memory 62 is empty, the memory empty detector device 65 is provided which functions merely to sense whether 66 codes successively read from the column memory consist of all zero codes. If the detector 65 determines that the column memory 62 is empty, (meaning it contains 66 all zero codes), then it provides the transfer command signal on line 64 to transfer the succeeding column of 66 six-bit codes from the page memory 60 to the column memory 62. In addition, in conjunction with the transfer of 66 codes from the page memory 60 to the column memory 62, the detector 65 provides a command signal to the paper step means (not shown) to step the paper by a distance equal to the spacing between adjacent columns of text.

The particular column of information transferred from the page memory 60 to the column memory 62 is determined by the address stored in address register 82. The address register 82 is incremented by the output signal developed by the memory empty detector 65. Thus, it should be appreciated that in the course of printing a page, the address defined by the address register 82 will be incremented in steps from 1 to 132. When the address register 82 defines the maximum column number, herein assumed to be 132, this state is recognized by state detector 84 which enables AND gate 86 to load a subsequent page of 8,712 six-bit character codes into the page memory 60 from some external storage means, such as a digital computer. The load data command signal developed by state detector 84 in addition causes the paper control mechanism to index the paper web to the first column of the next page.

From the foregoing, it should now be appreciated that an impact printer has been disclosed herein utilizing a drum mounted so as to move the characters thereon past the print station along the lines to be printed. As a consequence, errors in vertical registration are eliminated. In addition to providing improved vertical registration, a printer constructed in accordance with the present invention enables page formats of various column widths to be provided. That is, without modifying the drum or hammer configuration, page formats of varying widths such as 80 columns or 160 columns can be produced.

For typical applications, the total number of hammers required in accordance with the present invention is less than for conventional line printers since the number of lines per page is normally considerably less than the number of columns per page. In addition, the cost of a hammer assembly is reduced because the line-to-line spacing between the hammers is normally greater than the column-to-column spacing in conventional drum printers. More particularly, in conventional drum line printers, the center-to-center spacing between hammers is 1/10 of an inch while in accordance with the present invention, it would typically be 1/6 of an inch, meaning that tolerances can be somewhat greater and manufacturing costs somewhat lower.

The embodiments of the invention in which an exclusive property or privilege is claimed are defined as follows:

1. An apparatus for printing a page of text by printing successive vertical columns, each column containing one character in each horizontal line of text, said apparatus comprising:

a plurality of hammers having impact faces disposed in alignment along a print row;

a cylindrical drum mounted adjacent to said hammers with the axis of said drum extending parallel to said print row;

a plurality of raised characters formed on the surface of said drum disposed in columns extending parallel to said drum axis and rings extending around said drum axis, said characters being shaped to define letters of the alphabet and being oriented such that the shortest possible line between the top and bottom of each character extends substantially parallel to said drum axis;

means for continually rotating said drum about said drum axis to sequentially bring successive columns of characters on said drum surface into alignment with said print row;

means for alternately moving and stopping a paper web to be printed upon along a path between said drum and said hammers;

a first memory means for storing a plurality of codes equal in number to said plurality of hammers, each code identifying a character to be printed in a particular line of a single column of text;

a second memory means for storing multiple sets of codes, each set identifying the characters to be printed in a particular column of text;

means for transferring each of said code sets, one set at a time, from said second memory means to said first memory means, in substantial time coincidence with said moving of said paper web;

character counter means defining a code identifying the next character column moving into alignment with said print row;

means for generating a timing pulse in synchronism with each successive character column moving into alignment with said print row;

means responsive to each timing pulse for changing the code defined by said character counter means;

means operable between successive timing pulses for sequentially comparing all of said codes stored by said first memory means with the code identified by said character counter means to detect matches therebetween;

a hammer command register including a plurality of binary stages, each operably connected to a different one of said plurality of hammers, each stage capable of selectively defining a set or reset state;

means responsive to each match detected by said comparing means for forcing a stage of said hammer command register to said set state; and means responsive to all hammer command register stages defining a set state for simultaneously impacting the hammers connected thereto against said drum.

2. The apparatus of claim 1 including means for generating one index pulse per drum revolution and in synchronism therewith; and means responsive after each index pulse to said comparing means detecting a match with respect to all of said codes stored in said first memory means for moving said paper web a unit distance equal to the spacing between columns being printed.

* * * * *